US005203911A

United States Patent [19]

Sricharoenchaikit et al.

[11] Patent Number: 5,203,911

[45] Date of Patent: Apr. 20, 1993

[54] CONTROLLED ELECTROLESS PLATING

[75] Inventors: Prasit Sricharoenchaikit, Millis; Gary S. Calabrese, North Andover; Michael Gulla, Millis, all of Mass.

[73] Assignee: Shipley Company Inc., Newton, Mass.

[21] Appl. No.: 719,979

[22] Filed: Jun. 24, 1991

[51] Int. Cl.[5] ..... C23C 18/34; C23C 18/40

[52] U.S. Cl. ..... 106/1.26; 106/1.27; 427/443.1

[58] Field of Search ..... 106/1.23–1.27; 427/443.1

[56] References Cited

U.S. PATENT DOCUMENTS 3,431,120 3/1969 Weisenberger ..... 106/1.27

OTHER PUBLICATIONS

Mallory, G. O. and Haidu, J. B., eds. Electroless *Plating: Fundamentals and Applications* (American Electro-Platers and Surface Finishers Society, Orlando, FL 1990, pp. 88–89).

Duffek, E. F; Baudrand, D. W.; Donaldson, J. G., *Electroess Plating: Fundamentals and Applications*, (American Electroplaters and Surface Finishers Society Orlando, FL 1990, p. (253).

Subramanian, R.; Selvam, M. Srinivasan, K. N., *Bulletin of Electrochemistry*, 4, 25 (1988).

Petukhov, I. V.; Kuznetsova, E. V.; *Journal of Applied Chemistry of the USSR* (Eng. Trans.), 1989, 62(9), pp. 1999–2000.

Rust, R. D., *Printed Circuit Fabrication*, Jun. 1987, pp. 37–44.

Chang, Y. S.; Lee, J. Y., *Proceedings of the International Electronic Devices and Materials Symposium*, Taiwan, 1984 p. 491.

Chang, Y. S.; Hsieh, J; Chen, H., *Journal of Applied Physics*, 65, 154 (1989).

Chang, Y. S.; Chou, M. L., *Materials Chemistry and Physics*, 24, 131 (1989).

*Primary Examiner*—Mark L. Bell
*Assistant Examiner*—Margaret Einsmann
*Attorney, Agent, or Firm*—Robert L. Goldberg

[57] ABSTRACT

A composition for electrolessly depositing thin metal coatings in selective patterns of fine dimension. The electroless plating solutions of the invention are characterized by a low metal content and preferably, freedom from alkali or alkaline earth metal ions.

16 Claims, 3 Drawing Sheets

CONTROLLED ELECTROLESS PLATING

BACKGROUND OF THE INVENTION

1. Introduction

This invention relates to electroless metal plating and more particularly, to compositions and processes adapted to deposit a thin metal coating by electroless deposition at a controlled rate in a pattern of fine features. In one embodiment of the invention, the plating composition is essentially free of alkali or alkaline earth metal ions.

2. Description of the Prior Art

Electroless metal plating refers to the coating of surfaces with metal using a process in which a reducing agent reduces metal ions in solution to elemental metal onto a surface in the presence of a plating catalyst. The term "electroless" refers to the absence of an external electrical current. Electroless metal deposition is more fully described by G. O. Mallory and J. B. Hajdu, eds. *Electroless Plating: Fundamentals and Applications* (American Electroplaters and Surface Finishers Society, Orlando, Fla.) 1990, and R. Subramanian, M. Selvam, K. N. Srinivasan, *Bulletin of Electrochemistry*, 4, 25 (1988), both incorporated herein by reference.

Processes and compositions for electroless deposition of metals are known in the art and are in substantial commercial use. They are disclosed in a number of prior art patents, for example, copper plating solutions are disclosed in U.S. Pat. Nos. 3,615,732; 3,615,733; 3,728,137; 3,846,138; 4,229,218; and 4,453,904, all incorporated herein by reference. Electroless nickel plating solutions are described in U.S.. Pat. Nos. 2,690,401; 2,690,402; 2,762,723; 3,420,680; 3,515,564; and 4,467,067, all incorporated herein by reference. Many copper, nickel and cobalt plating solutions are commercially available. Other metals that may be electrolessly deposited include gold, indium, iridium, iron, lead, osmium, palladium, platinum, rhodium, ruthenium, silver, tin and vanadium. Various alloys, such as copper and nickel alloys, or alloys of metals with other elements such as phosphorus or boron, are also capable of electroless metal deposition. The preferred electroless metals for purposes of this invention are copper, cobalt and nickel.

Known electroless metal deposition solutions generally comprise four ingredients dissolved in water. They are (1) a source of metal ions, usually a metal salt such as copper or nickel sulfate, (2) a reducing agent such as formaldehyde for copper solutions, hypophosphite for nickel solutions, or dimethyl amine boranes for both, (3) a pH adjustor such as hydroxide for copper solutions or an acid for nickel solutions and (4) one or more complexing agents for the metal sufficient to prevent precipitation of the metal from solution. Other additives typically contained in such plating solutions include stabilizers, exaltants, etc.

Typical metal ion sources are the chloride or sulfate salts, but nitrates and even oxides are sometimes used, as well as more complex salts such as sodium choloroplatinate, $Na_2PtCl_6$, or potassium cyanoaurate, $KAu(CN)_2$.

The reducing agents most commonly used in electroless plating solutions are sodium hypophosphite for nickel plating solutions, formaldehyde for copper plating solutions, sometimes generated from its polymer paraformaldehyde, hydrazine, ammonium borohydride and amineborane complexes such as dimethylamine borane, and sodium borohydride for each.

Complexing agents often used are mono-, hydroxy-, and dicarboxylic acids; pyrophosphates; ethylenediaminetetraacetic acid (EDTA); ethanolamines; etc., dependent in part on the metal to be held in solution. Some complexing agents, such as lactic acid, can function as buffers and exaltants as well. In fact, mixtures of hydroxy- and dicarboxylic acids with their salts, as well as organic amines, are common buffers.

There are a variety of uses for electroless plating in engineering and electronics. In engineering, electroless coatings of nickel are used as protective coatings in the aerospace, automotive, chemical processing, petroleum and gas, food processing, and mining and materials handling industries. In the electronics industry, electroless metal coatings have been used for coatings, contacts, heat sinks, and conductors. For these applications, the requirements of industry have dictated that most deposits be thick and deposited at a rapid rate. U.S. Pat. No. 4,467,067, for example, describes an electroless nickel plating solution in which the claimed improvement is an increase in plating rate produced by the inclusion of a polymer of a 2-acrylamido- or 2-methacrylamidoalkyl sulfonic acid. Deposition of nickel at low rates has been disclosed as undesirable in Petukhov, I. V.; Kuznetsova, E. V.; *Journal of Applied Chemistry of the USSR* (Eng. trans.), 1989, 62(9), 1999–2000.

There are new applications where the deposition of very thin coatings of metal in patterns having extremely fine dimensions would be desirable. R. D. Rust, in *Printed Circuit Fabrication*, June, 1987, (37–44), discusses the increasing resolution and fineness of the dimensions required by the printed circuit and integrated circuit industries. Extrapolation of the graph on page 37 of Rust indicates a trend towards maximum line widths of 0.05 mils (1.25 microns) in 1985, and 0.02 mils (0.5 microns) in 1990. European Patent Application 0 397 988 discusses the needs of the integrated circuit industry for an improved process for providing dry etch resistant metal masks in a selective pattern having features of one micron or less in thin section over photoresists for transfer of micron and submicron images to a substrate.

The deposition of thin metal films has been tried by a number of methods, for example by vacuum plating, sputtering, etc., but with few exceptions, not by electroless plating. A very thin layer, about 0.05 microns, of electrolessly deposited nickel was disclosed in JP 01 55,387, reported in Chemical Abstracts 112:58281. However, the substrate required heating to 500° F., and included phosphorus as part of the deposition bath, a component that is known to deposit with the nickel, reducing the purity of the layer. In electronic applications, such impurities are undesirable, because they reduce the conductivity of the deposited metals to unsatisfactory levels.

Electroless deposition of thin metal films, including nickel, of 0.05 to 2.0 microns is disclosed in U.S. Pat. No. 4,913,768. The plating solutions contain a high concentration of nickel. It is believed that control of the plating rate to obtain consistently thin deposits would be difficult with baths having this high a metal content. Moreover, in all of the examples in which nickel was plated, the plating bath contained hypophosphite, the disadvantage of which was discussed above.

The same disadvantage applies to coatings disclosed in U.S. Pat. No. 4,911,981. Although thin and controllable metal coats are described for a process using self-assembled lipid microtubules as a substrate for copper, nickel, and other metals, the nickel coat is acknowledged to be impure. When copper was used as the metal, the coating was also described as thin and uniform, but a controlling factor in this process is clearly the configuration of the surface being plated, and not the plating composition, because commercially available solutions were used.

Y. S. Chang and coworkers have published a series of reports on the electroless deposition of thin films of several metals, with reference to the potential that their studies hold for the development of microelectronics technology.

Y. S. Chang and J. Y. Lee disclose the electroless deposition of thin nickel coatings in *Proceedings of the International Electronic Devices and Materials Symposium,* Taiwan, 1984, p. 491. The composition of the plating solution is not disclosed, however, and the deposition rate is reported to be 300 Angstroms/minute. Again, the reducing agent was hypophosphite, the disadvantage of which was discussed above.

Y. S. Chang, J. Hsieh, and H. Chen report the electroless deposition of thin coats of iron/nickel alloy (95:5) at about 70 Angstroms/min, in the *Journal of Applied Physics,* 65, 154 (1989). The plating composition was again not disclosed, and the temperature and pH were high, about 80° C., and 12, respectively.

Y. S. Chang and J. J. Chu report electroless deposition of thin films of ruthenium in *Materials Letters,* 5, 67 (1987), but again, except for the presence of a hypophosphite reducing agent, the plating composition was not disclosed, and the temperature and pH were high.

Y. S. Chang and M. L. Chou partially report a composition for electrolessly plating osmium thin films in *Materials Chemistry and Physics,* 24, 131 (1989). On page 139, they describe a film with a thickness of 140 Angstroms after 3 minutes' immersion, or almost 50 Angstroms per minute, deposited from a solution where the osmium concentration was 0.01M. A fluctuation in thickness was acknowledged to be 30 Angstroms, or more than +/−20%, and the disadvantages of reducing agent, temperature, and pH were the same as those mentioned in the three references above. In this case, the identity of the reducing agent was reported as sodium hypophosphite, an additional disadvantage of which is the alkali metal ion. Sodium hydroxide was also reported as a component.

PCT Application WO 90/00634, corresponding to U.S. applications Ser. Nos. 216,406, filed Jul. 7, 1988, and 351,962, filed May 17, 1989, discloses a composition and process for electrolessly plating polymers with a variety of metals in thicknesses between 0.001 micron (10 Angstroms) and 100 microns (100,000 Angstroms), in order to produce electrical conductors or semiconductors. However, the process includes treatment of the surface with a strong base, preferably potassium t-butoxide, which contains an alkali metal ion. Also, the concentration of metal is specified as at least 0.01M, and typically 0.2M.

It is believed that decrease of the metal concentration as a means of obtaining thin films has not been attempted in the prior art. G. O. Mallory, in Mallory and Hajdu, cited above, discussing the effect of nickel concentration on the plating rate, state on pp. 88–89, "The rate of deposition is independent of nickel concentration when the nickel concentration is >0.06M (about 3.5 g/L). When the nickel concentration is less than 0.06M, there is a strong dependence of rate on nickel concentration. However, plating baths are not operated at these low concentrations of $Ni^{++}$ ions. Detailed studies on the effect of the molar ratio of nickel ions to DMAB are not available in the literature."

E. F. Duffek, D. W. Baudrand, and J. G. Donaldson, in the same reference, discuss deposit monitoring on page 253 where it is stated "With suitable process controls in place, the deposition rate of an electroless nickel solution is quite predictable, and a typical plating specification of 0.0002 to 0.0004 in., or 0.0004 to 0.0007 in. is easy to meet. Thicker coatings of 2–3 mils may prove to be more of a problem, particularly when the specified range may be a seemingly impossible +/−0.0001 in."

SUMMARY OF THE INVENTION

This invention relates to electroless metal deposits suitable for use as masks over organic coatings during reactive ion etching in the manufacture of integrated circuits such as for those processes disclosed in the above referenced EPO Application No. 0 397 988. For such use, the metal is desirably deposited in thin cross section in a fine featured pattern having good edge acuity. For purposes of this invention, metal deposits having a maximum dimension in the X and Y axes (thickness and width) of two microns or less is desirable. Preferably, the maximum dimension in the X and Y axes does not exceed one micron.

To obtain a fine featured, thin deposit as desired herein, it is necessary that the metal depositing solution provide a fine grain deposit at a controlled, relatively slow rate of deposition. It is one discovery of this invention that such deposits can be obtained from solutions having a relatively low metal content with other solution components reduced in concentration to maintain a controlled plating rate at low solution temperature. Preferably, the total metal content of the plating solution does not exceed 0.01 moles per liter with solution components in a concentration whereby plating rate does not exceed 100 Angstroms per minute from a solution maintained at room temperature.

For manufacture of integrated circuits, it is desirable to avoid alkali and alkaline earth metal ions that diffuse readily into a silicon substrate. Consequently, the plating solutions of the invention are preferably essentially free of such ions and desirably are free of all metal ions other than the ions of the plating metal.

In addition to the above, to obtain fine features, it is desirable that the solutions be free of particulates having a major dimension in excess of 1.0 micron and that the plating solution be used at a pH compatible with the organic coating over which the metal is deposited.

DESCRIPTION OF THE DRAWINGS

Each of the drawings is a photomicrograph of a nickel deposit in accordance with the invention.

DESCRIPTION OF THE PREFERRED EMBODIMENTS

Figure 1:
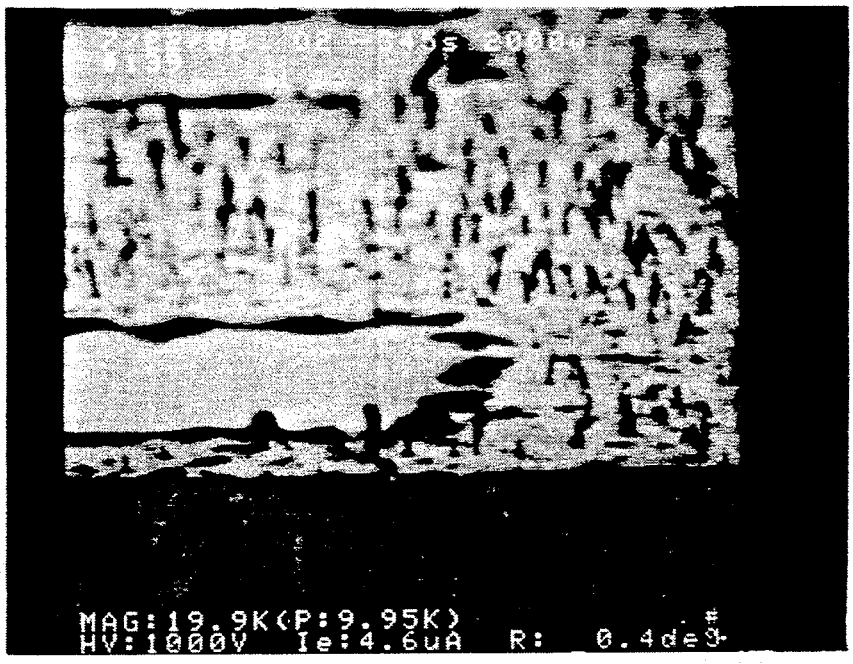

The composition of the invention comprises a solution of a salt of a metal that can be plated autocatalytically; a reducing agent which preferably does not deposit in significant amount onto the coated surface with the metal; additives known in the art for complexation of the metal salt, control of the pH, stabilization, and exaltation; and preferably, the plating solution is essentially free of all metal ions other than ions of the metal to be plated.

The metal to be plated according to the invention can be any of the metals that can be plated autocatalytically, for example, the most commonly plated metals, nickel, cobalt and copper and in addition, gold, indium, iridium, iron, lead, osmium, palladium, platinum, rhodium, ruthenium, silver, and tin. Various alloys such as copper and nickel alloys are suitable for purposes of the invention. The preferred metals for fabrication of integrated circuits are nickel and cobalt. The metals are included in solution in the form of their salts, for example, the chlorides, sulfates or nitrates. Sulfates are preferred. The metal content of the plating solution is maintained low, preferably in an amount not exceeding 0.02 moles per liter and more preferably within a range of from about 0.001 to 0.010 moles per liter.

Any of the reducing agents known in the art for electroless metal deposition may be used for the metal that it effectively reduces Preferred reducing agents are those that do not codeposit with the metal and which are free of alkali and alkaline earth metal ions. Though hypophosphite can be used for nickel and cobalt and formaldehyde or paraformaldehyde for copper, a preferred agent would be ammonium borohydride or dimethylamine borane for each of copper, nickel and cobalt. The concentration of the reducing agent in solution should be sufficient to reduce the metal in contact with the catalytic surface and preferably is present in an amount of at least one-half the molar content of the metal, preferably is at least equimolar with the plating metal and preferably, the concentration of the reducing agent varies from about 1 to 20 times the metal content in solution.

Complexing agents that can be used for nickel or cobalt baths include mono-, hydroxy-, amino-, and dicarboxylic acids, for example formic, acetic, propionic, glycolic, lactic, tartaric, malonic, succinic, malic, and citric acids; glycine; and alanine. Solutions for electroless copper deposition may include ethylenediaminetetraacetic acid (EDTA), various amines and tartaric acid as is known in the art. The concentration of complexing agent should be sufficient to maintain the metal dissolved in solution, preferably should be at least equimolar in concentration and more preferably, should vary from about 1 to 20 times the metal content.

Conventional acids or hydroxides are used to provide the desired solution pH. The pH selected is consistent with the plating solution. For example, copper plating solutions are conventionally alkaline having a pH of 10 or greater and nickel plating solutions are typically acid, having a pH of 3 or less. When selecting the pH adjustor, as with the other solution components, it is desirable to essentially eliminate mobile metal ions. For example, where sodium hydroxide is a conventional pH adjustor, for purposes of this invention, ammonium hydroxide would be preferred. In a preferred embodiment of the invention, the pH of the plating solutions are adjusted so as to be compatible and not attack the organic coatings over which they are deposited. For example, an alkaline plating solution is undesirable for contact with a positive acting photoresist comprising a novolak resin and a naphthoquinone diazide sulfonic acid ester because such resists are attacked by strong alkali. For most applications, a plating solution having a neutral pH (7.0) is desired. This is possible with amine borane reducing agents. Consequently, in a preferred embodiment of the invention, a plating solution would be used containing an amine borane reducing agent at pH between about 6 and 8, and preferably at pH about 7.0.

In a preferred embodiment of the invention, the concentration of solution components are regulated whereby plating rate of metal from solution onto a substrate does not exceed 100 Angstroms per minute and more preferably, varies between about 5 and 50 Angstroms per minute from a solution maintained at about room temperature.

In practice, a surface to be plated is catalyzed prior to plating and may require an additional step of activation or acceleration. Catalysis involves deposition of a material that is catalytic to electroless metal deposition onto the surface of the photoresist. Although a catalyst is necessary to initiate deposition, it is not a component of the plating bath, but is added to the surface to be plated in a pretreatment step. The deposited metal assumes the role of the catalyst as it begins to build up on the surface over which it is plated; i.e., it is self-catalyzing, hence the term "autocatalytic plating".

The process of catalysis comprises contact, typically by immersion of the substrate to be coated, with an aqueous solution of the catalyst for a time sufficient to adsorb an adequate amount of catalyst onto the surface. Immersion times generally vary from about 15 seconds to 10 minutes in a solution varying in temperature from about room temperature to 50° C. or higher.

Catalyst compositions for electroless metal deposition are known to those skilled in the art and are disclosed in U.S. Pat. No. 3,011,920 incorporated herein by reference. The method of this patent comprises catalyzing a substrate by treatment with a bath containing colloidal particles formed by reducing a catalytic metal with tin. The catalytic metal is typically a precious metal and is most often palladium. The oxidation product of the tin salt is believed to form a protective colloid. Numerous improvements have been made in this process and in the composition of the colloidal catalyst bath as disclosed in, for example, U.S. Pat. Nos. 3,719,508; 3,728,137; 3,977,884; and 4,725,314. With respect to U.S. Pat. No. 4,725,314, there is described preparation of catalyst particles of dimensions not exceeding 500 angstroms (0.05 microns). For purposes of this invention, plating catalysts having particles of small dimension such as 500 Angstroms or less are preferred.

Following catalysis, the surface to be plated may be subjected to a step of acceleration in accordance with art recognized processes. Acceleration comprises contact of the catalyzed surface with an acidic or alkaline solution to remove protective colloids formed during catalysis. It should be noted that not all catalysts require a step of acceleration. Acceleration is discussed in U.S. Pat. No. 3,011,920 referenced above.

A preferred method for acceleration comprises contact of the catalyzed surface with a dilute solution of dissolved noble metal, preferably palladium dissolved in dilute hydrochloric acid solution. The use of such a solution results in substantial improvement in line acuity following metal deposition. A solution containing from about 0.01 to 5.0 weight percent of a salt of the noble metal is suitable, and preferably from about 0.1 to 2.0 weight percent.

Following acceleration, electroless metal is deposited over the catalyst layer in the image pattern. Electroless plating solutions are used for the process disclosed herein in the same manner as for other industrial applications though conditions are desirably used to deliver the plating rate. In a preferred embodiment of the invention, significantly thinner coatings are used compared to the thickness of the coating required for prior art applications.

One condition used to control and lower plating rate is temperature. Preferably, room temperature plating results in a plating rate not exceeding about 10 Angstroms per minute. Depending on the nature of the catalyst, a continuous film can be observed after deposition of about 30 to 400 Angstroms in extreme cases, and more usually 50 to 200 Angstroms.

In order to plate a surface with a fine featured deposit free of disruptions, it is desirable that the metal plating solution be free of particulates having a major dimension in excess of 1.0 microns and more preferably, be free of particulates having a major dimension in excess of 0.1 microns. To obtain particulate free plating solutions, in a preferred embodiment of the invention, the plating solutions are filtered prior to deposition, typically at the time of manufacture of such solutions.

The compositions of the invention have several advantages over prior art compositions. First, the low concentration of metal in solution permits slow and controlled deposition resulting in thin coatings of well controlled thicknesses, and, where processed appropriately, fine lines with good edge acuity. For example, uniform and continuous metal coating of less than 1,000 Angstroms with uniform thickness can be consistently reproduced. Moreover, the solutions of the invention are more stable than prior art solutions and are more readily waste treated.

A metal deposit of nickel and cobalt having a high degree of purity free of phosphorus may be obtained using an amine borane as the reducing agent instead of hypophosphite. In this instance, boron will codeposit with the metal. Hydrazine can be used as a less preferred reducing agent, though it is not as safe to use as the amine-borane complexes.

The invention is applicable to the preparation of printed circuits, integrated circuits, and optical coatings such as diffraction patterns or lens coatings. The invention is especially well suited for deposition of metal in processes involving a step of reactive ion etching such as that disclosed in the above referenced EPO Application No. 0 397 988. Using the process of the EPO application for purposes of illustration, a photoresist would be applied over a suitable substrate, imaged, especially in a fine featured pattern, catalyzed and then at least partially developed whereby catalyst would be washed away with photoresist removed by the step of development. The result would be a partially developed photoresist coating having a catalyzed surface in a desired fine featured image pattern. The catalyst surface would then be metallized by immersion in the metal plating solution of the invention, preferably at room temperature, for a time sufficient to deposit a thin metal plate having a desired maximum thickness of two microns, and preferably one micron. The time to deposit such a coating would be dependent upon the solution used and the plating time as would be known to those skilled in the art. Typically, a plating time of about five minutes is adequate.

The following examples are provided for purposes of illustration.

EXAMPLE 1

The following plating solution was prepared:

| | |
|---|---|
| nickel sulfate hexahydrate | $3.8 \times 10^{-3}$ moles/liter |
| citric acid | $2.6 \times 10^{-3}$ moles/liter |
| dimethylamine borane | $1.7 \times 10^{-3}$ moles/liter |
| ammonium bicarbonate | $3.3 \times 10^{-4}$ moles/liter |
| stabilizers(1) | $9.9 \times 10^{-5}$ moles/liter |
| ammonium hydroxide | $1.8 \times 10^{-2}$ moles/liter |
| water | to make 1 liter |

(1)The stabilizers used were proprietary sulfur containing stabilizers.

A pair of silicon wafers were spin coated with a positive working Microposit S1813 photoresist (available from Shipley Company Inc. of Newton, Mass.) to a thickness of 1.23 microns, dried, and exposed through a mask using a DSW stepper made by GCA Corporation. The wafers were then subjected to the following treatment steps:

immerse in Cataprep 404 conditioner(1) at 85° F. for 1 minute;

immerse in 6% Cataposit 44 catalyst(2) diluted with Cataprep 404, at 120° F. for 4 minutes;

rinse with deionized water;

immerse in accelerator 240(3) at 95° F. for 1 minute;

rinse with deionized water;

develop by immersion in 1:1 Microposit(4) developer for 1 minute at room temperature; and immerse in above nickel plating solution at 86° F. for 8 min.

(1) Cataprep Condition 404 is a proprietary amine solution.
(2) Cataposit 44 is a tin palladium colloidal plating catalyst.
(3) Accelerator 240 is a proprietary acidic solution available from Shipley Company Inc. of Newton, Mass.
(4) Microposit developer is a proprietary alkaline quaternary ammonium hydroxide.

Metal was deposited in a pattern over non-exposed areas. The metallized wafers were then subjected to reactive ion etching (RIE) to remove resist not coated with metal. RIE was carried out by exposure to an oxygen plasma for 345 seconds at a 2000 W magnetron setting, and the results studied by scanning electron microscopy (SEM). A continuous, but slightly rough nickel layer was observed. Analysis by Rutherford back scattering spectrometry (RBS) revealed a nickel density of $6.82 \times 10^{16}$ atoms/cm$^2$ having a deposit thickness of 74.7 Angstroms.

EXAMPLES 2 to 18

For these examples, the plating process used was the same as used in Example 1. The results are as set forth in the following table where a (+) indicates acceptable results and a (−) indicates results not considered acceptable for use in the formation of integrated circuits. In the table, C means consistency of the nickel deposit; S means smoothness of the nickel deposit; D means density of the deposit in 1016 atoms/cm$^2$ and T means thickness of the deposit in Angstroms.

| Example Number | Plating Time (min) | SEM results C | SEM results S | RBS Results D | RBS Results T |
|---|---|---|---|---|---|
| 2 | 8.5 | + | − | 6.89 | 75.5 |
| 3 | 7.5 | + | − | 8.11 | 88.8 |
| 4 | 7.0 | + | + | 5.09 | 55.7 |
| 5 | 6.5 | + | + | 6.68 | 73.2 |
| 6 | 6.0 | + | + | 6.99 | 76.6 |
| 7 | 5.5 | + | ++ | 5.05 | 55.3 |
| 8 | 5.0 | + | nm | 8.31 | 91.0 |
| 9 | 4.5 | + | + | 8.24 | 90.2 |
| 10 | 4.0 | − | − | 8.15 | 89.3 |
| 11 | 3.5 | nm | nm | nm | nm |
| 12 | 3.5 | nm | nm | 5.44 | 59.6 |
| 13 | 3.0 | − | −− | 5.11 | 56.0 |

-continued

| Example Number | Plating Time (min) | SEM results C | SEM results S | RBS Results D | RBS Results T |
|---|---|---|---|---|---|
| 14 | 2.5 | – | – – | 4.31 | 47.2 |
| 15 | 2.0 | – | – – | 1.34 | 14.7 |
| 16 | 1.5 | nm | nm | nm | nm |
| 17 | 1.0 | nm | nm | 2.02 | 22.1 |
| 18 | 0.5 | nm | nm | 0.5 | 6.0 |

It is apparent from the table that the smoothest continuous nickel layer resulted from a 5.5 minute immersion at 30° C. for this application. Other optimum conditions would be required for other applications. It should be noted that an apparent lack of correlation between the results of SEM and RBS analysis is due to the small area on which RBS analysis focuses. If a well covered point is chosen, the nickel layer will seem to be more substantial than the SEM scan reveals it to be.

Figure 2:
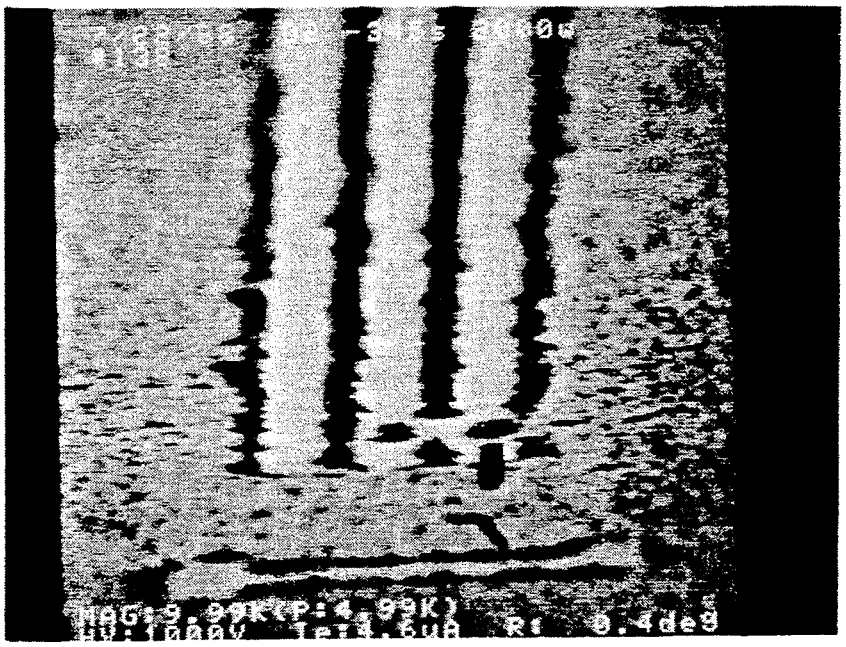
Figure 3:
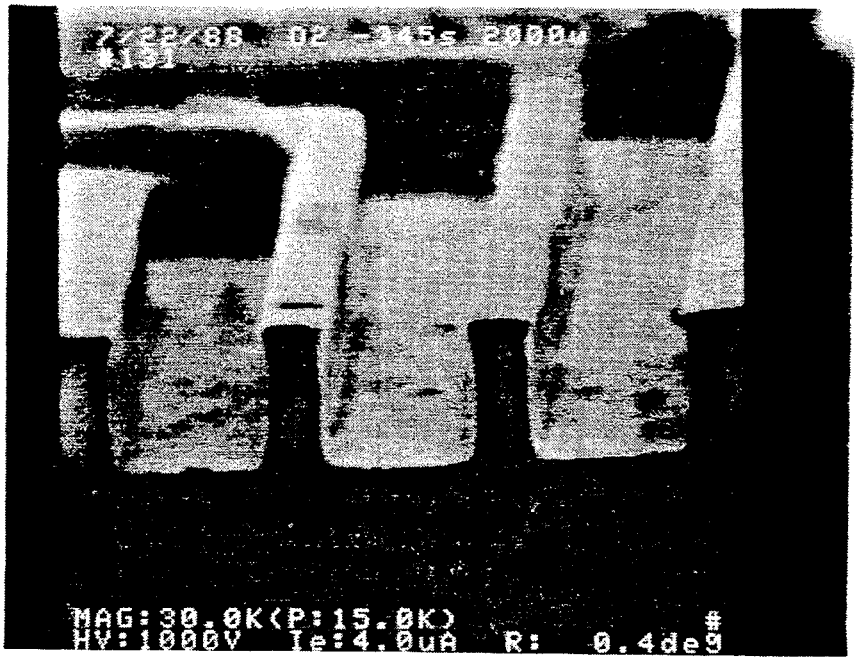

Three wafers prepared in accordance with the above procedure were photographed under magnification. FIG. 1 of the drawings is a photograph at a magnification of 19,900× of Example 15. FIG. 2 is a photograph at 9,900× magnification of Sample No. 14. Although the photoresist has been protected for the most part, the nickel layer is not sufficiently continuous to define the edges of the pattern adequately. FIG. 3 is a photograph of Sample No. 7 at a magnification of 30,000×. The smooth plateau demonstrates the consistency of protection afforded by the nickel layer.

EXAMPLE 19

An alternative nickel plating solution would have a formulation as follows:

| | |
|---|---|
| nickel sulfate hexahydrate | $7.6 \times 10^{-3}$ moles/liter |
| ammonium citrate | $3.4 \times 10^{-3}$ moles/liter |
| lactic acid | $5.6 \times 10^{-3}$ moles/liter |
| dimethylamine borane | $1.7 \times 10^{-3}$ moles/liter |
| ammonium hydroxide | to pH 6 to 7 |
| water | to make 1 liter |

Use of the formulation set forth above would be expected to provide results comparable to those of Examples 2 to 18.

EXAMPLE 20

The procedure of Examples 2 to 18 may be repeated substituting the following cobalt plating solution for the nickel solution used in said examples.

| | |
|---|---|
| cobalt sulfate hexahydrate | $3.1 \times 10^{-3}$ moles/liter |
| ammonium succinate | $6.9 \times 10^{-3}$ moles/liter |
| ammonium sulfate | $3.9 \times 10^{-3}$ moles/liter |
| dimethylamine borane | $3.4 \times 10^{-3}$ moles/liter |
| ammonium hydroxide | to pH 5 to 7 |
| water | to make 1 liter |

EXAMPLE 21

The procedure of Examples 2 to 18 may be repeated substituting the following copper plating solution for the nickel solution used in said examples though this example is a lesser preferred embodiment because of the use of sodium and potassium cations.

| | |
|---|---|
| copper sulfate pentaahydrate | $3.1 \times 10^{-3}$ moles/liter |
| Na/K tartrate tetrahydrate | $4.4 \times 10^{-3}$ moles/liter |
| formaldehyde | $6.1 \times 10^{-3}$ moles/liter |

-continued

| | |
|---|---|
| sodium hydroxide | $8.8 \times 10^{-3}$ moles/liter |
| water | to make 1 liter |
| pH | 12.5 |

The above examples are provided only for the purpose of illustration and are not to be taken as limiting the scope of the invention.

We claim:

1. An aqueous electroless metal plating solution comprising a source of metal ions, a complexing agent for said metal ions, a reducing agent capable of reducing said metal ions to metallic form in the presence of a catalytic surface and a pH adjustor, said metal ions being present in a concentration ranging between about 0.001 and 0.01 moles per liter and said remaining solution components being present in solution in a concentration whereby the rate at which metal plates from solution does not exceed 100 Angstroms per minute.

2. The solution of claim 1 where solution components are present in solution in a concentration whereby the rate varies between about 5 and 50 Angstroms per minute and the plating solution is free of particulates having a major dimension exceeding 1.0 microns.

3. The solution of claim 1 where solution components are present in solution in a concentration whereby the rate does not exceed 10 Angstroms per minute and the plating solution is free of particulates having a major dimension exceeding 0.1 microns.

4. The solution of claim 1 where said metal ions are selected from the group of nickel, cobalt, copper and mixtures thereof.

5. The solution of claim 4 where said metal ions are nickel ions.

6. The solution of claim 1 essentially free of alkali and alkaline earth metal ions.

7. The solution of claim 1 where the reducing agent is one that does not codeposit with the metal to be plated in appreciable quantity.

8. The solution of claim 1 where the reducing agent is selected from the group consisting of amine boranes and ammonium borohydride.

9. The solution of claim 1 having an essentially neutral pH.

10. An aqueous electroless nickel plating solution comprising a source of nickel ions, a complexing agent for said nickel ions, a reducing agent capable of reducing said nickel ions to metallic form in the presence of a catalytic surface and a pH adjustor, said nickel ions being present in a concentration ranging between about 0.001 and 0.01 moles per liter and said remaining solution components being present in solution in a concentration whereby the rate at which nickel plates from solution does not exceed 100 Angstroms per minute.

11. The solution of claim 10 where solution components are present in solution in a concentration whereby the rate varies between about 5 and 50 Angstroms per minute.

12. The solution of claim 10 where solution components are present in solution in a concentration whereby the rate does not exceed 10 Angstroms minute

13. The solution of claim 10 essentially free of alkali and alkaline earth metal ions.

14. The solution of claim 10 where the reducing agent is one that does not codeposit with nickel in appreciable quantity.

15. The solution of claim 10 where the reducing agent is an amine borane.

16. The solution of claim 10 having an essentially neutral pH.

* * * * *